US010533384B2

(12) United States Patent
Jones et al.

(10) Patent No.: US 10,533,384 B2
(45) Date of Patent: Jan. 14, 2020

(54) SCREW CONVEYOR CENTRIFUGE INCLUDING A COMPOSITE MATERIAL AND METHOD OF USE

(75) Inventors: Bradley Jones, Crestview Hills, KY (US); Thomas Geehan, Houston, TX (US)

(73) Assignee: M-I L.L.C., Houston, TX (US)

( * ) Notice: Subject to any disclaimer, the term of this patent is extended or adjusted under 35 U.S.C. 154(b) by 481 days.

(21) Appl. No.: 13/500,291

(22) PCT Filed: Oct. 6, 2010

(86) PCT No.: PCT/US2010/051620

§ 371 (c)(1),
(2), (4) Date: Jun. 13, 2012

(87) PCT Pub. No.: WO2011/044227

PCT Pub. Date: Apr. 14, 2011

(65) Prior Publication Data

US 2012/0245014 A1 Sep. 27, 2012

Related U.S. Application Data

(60) Provisional application No. 61/249,110, filed on Oct. 6, 2009.

(51) Int. Cl.

| | |
|---|---|
| ***B04B 1/20*** | (2006.01) |
| ***B04B 7/08*** | (2006.01) |
| ***E21B 21/06*** | (2006.01) |

(52) U.S. Cl.

CPC ..... *E21B 21/065* (2013.01); *B04B 1/20* (2013.01); *B04B 1/2008* (2013.01); *B04B 7/085* (2013.01);

(Continued)

(58) Field of Classification Search

CPC ..... B04B 1/2008; B04B 7/085; B04B 1/20; B04B 2001/2091; B04B 7/04; B04B 7/08; E21B 21/065

(Continued)

(56) References Cited

U.S. PATENT DOCUMENTS 3,012,710 A * 12/1961 Steinacker ..... B04B 7/08 220/62.11

4,262,840 A 4/1981 Groenert et al.

(Continued)

FOREIGN PATENT DOCUMENTS

CN 2607445 Y 3/2004
CN 2755280 Y 2/2006

(Continued)

OTHER PUBLICATIONS

Records A, Sutherland K. Decanter Centrifuge Handbook. [Electronic Resource] [e-book]. Oxford; New York: Elsevier Science B.V., 2001.; 2001. Available from: STIC Catalog, Ipswich, MA. Accessed Jan. 22, 2015.*

(Continued)

*Primary Examiner* — Charles Cooley
(74) *Attorney, Agent, or Firm* — Jeffrey D. Frantz

(57) ABSTRACT

A centrifuge, including a bowl having a composite material, a screw conveyor rotatably mounted within the bowl, and a feed pipe mounted within the screw conveyor for feeding a drilling mud through a feed port in a wall of the screw conveyor to an annular space between the bowl and the wall of the screw conveyor. Also, a method of replacing a centrifuge component, including removing the centrifuge component and installing a new centrifuge component, where the centrifuge components include a bowl and a screw conveyor rotatably mounted within the bowl, and where the new centrifuge component includes a composite material.

15 Claims, 2 Drawing Sheets

(52) U.S. Cl.
CPC ... *B04B 2001/2091* (2013.01); *Y10T 29/4973* (2015.01)

(58) Field of Classification Search
USPC ..... 494/10, 37, 52, 53, 54, 81, 50
See application file for complete search history.

(56) References Cited

U.S. PATENT DOCUMENTS

| | | | | | |
|---|---|---|---|---|---|
| 4,640,770 | A * | 2/1987 | Smith | B04B 9/12 | 210/144 |
| 5,156,751 | A * | 10/1992 | Miller | B01D 17/00 | 210/178 |
| 5,857,955 | A | 1/1999 | Phillips et al. | | |
| 5,948,271 | A * | 9/1999 | Wardwell et al. | 210/739 | |
| 6,033,564 | A * | 3/2000 | Kirker et al. | 210/232 | |
| 6,109,452 | A * | 8/2000 | Leung | B01D 33/067 | 210/369 |
| 6,123,656 | A * | 9/2000 | Michelsen | 494/54 | |
| 6,328,897 | B1 * | 12/2001 | Leung | B04B 11/043 | 210/143 |
| 6,790,169 | B2 | 9/2004 | Koch et al. | | |
| 7,001,324 | B2 | 2/2006 | Hensley et al. | | |
| 7,018,326 | B2 | 3/2006 | Koch et al. | | |
| 7,185,778 | B1 * | 3/2007 | Palley | B65D 88/14 | 220/1.5 |
| 2003/0228966 | A1 * | 12/2003 | Koch | B04B 1/20 | 494/53 |
| 2005/0087336 | A1 * | 4/2005 | Surjaatmadja | E21B 43/38 | 166/105.5 |
| 2006/0065605 | A1 * | 3/2006 | Kirker | B04B 1/00 | 210/748.05 |
| 2008/0196890 | A1 | 8/2008 | Fout et al. | | |
| 2011/0105292 | A1 * | 5/2011 | Walraven | B04B 1/20 | 494/5 |
| 2012/0245014 | A1 * | 9/2012 | Jones | B04B 1/20 | 494/37 |
| 2017/0014836 | A1 * | 1/2017 | Fisher | B04B 1/20 | |

FOREIGN PATENT DOCUMENTS

| | | | | |
|---|---|---|---|---|
| CN | 200955384 | Y | 10/2007 | |
| DE | 19961039 | A1 * | 6/2001 | B04B 7/085 |
| DE | 10040176 | B4 * | 9/2005 | |
| EP | 790862 | B1 | 6/2001 | |
| WO | 1994/15714 | A1 | 7/1994 | |

OTHER PUBLICATIONS

DE 19961039 Description Espacenet Machine Translation.*
International Search Report and Written Opinion issued in PCT/US2010/051620 dated May 24, 2011, 6 pages.
First Official Action issued in CN 201080055346.1 dated Mar. 7, 2014, 18 pages.
Second Official Action issued in CN 201080055346.1 dated Dec. 11, 2014, 8 pages.
Third Official Action issued in CN 201080055346.1 dated May 22, 2015, 14 pages.
Official Action issued in EA 201270506 dated Jun. 19, 2014, 4 pages.
Official Action issued in EA 201270506 dated Apr. 3, 2015, 4 pages.
Official Action issued in MX/A/2012/004071 dated May 30, 2014, 5 pages.
Second Official Action issued in MX/A/2012/004071 dated Sep. 25, 2014, 6 pages.
Third Official Action issued in MX/A/2012/004071 dated Mar. 9, 2015, 6 pages.
Office Action for the equivalent Chinese patent application 201080055346.1 dated Oct. 20, 2015.
Office Action for the equivalent Mexican patent application MX/a/2012/004071 dated Jun. 19, 2015.
Extended Search Report for the equivalent European patent application 10822597.0 dated Jan. 30, 2018.
Examination Report for the equivalent Brazilian patent application BR112012008216-7 dated May 22, 2019.
Communication pursuant to Article 94(3) for the equivalent European patent application 10822597.0 dated May 28, 2019.

* cited by examiner

SCREW CONVEYOR CENTRIFUGE INCLUDING A COMPOSITE MATERIAL AND METHOD OF USE

BACKGROUND

Field of the Disclosure

Embodiments disclosed herein relate generally to centrifuges manufactured using composite materials. More specifically, embodiments disclosed herein relate to centrifuges manufactured using high strength composite materials.

Background

Solid bowl decanting centrifuges are often used to separate liquid-solid mixtures. For example, well drill cuttings, drilling mud, slop oil, and other waste generated during drilling of wells and general chemical processing may be separated using a centrifuge. Such mixtures may include solids and one or more of oleaginous fluids and aqueous fluids.

The principle of centrifuge operation relies on the density difference between the solids and the liquids within a drilling fluid. As a rotational torque is applied to a centrifuge generating a centrifugal force (hereinafter, "G force"), the higher-density solids preferentially accumulate on the outer periphery inside the centrifuge, whereas the lower-density liquids preferentially accumulate closer to the axis of the centrifuge rotation. On the initial separation by the G force, the solids and the liquids can be removed from opposite sides of the centrifuge using a ribbon-type screw conveyor, sometimes referred to as a scroll.

Some challenges facing the operation of a centrifuge include high feed rates and varying solids content in the feed. As the feed rates increase, high speed and torque is typically required to accomplish the solids separation, thus resulting in increased footprint due to equipment size, and increased energy and operational costs. Wear and tear is also a concern due to effects of abrasive and corrosive materials in the feed, particularly where fluids and solids scrape against centrifuge components during operation.

In addition, centrifuge components must be able to maintain strength and rigidity during high speed operation in order to reduce deformation of the components, which eventually causes system vibrations and component breakdowns. Thus, conventional centrifuge components are typically made from stainless steel or carbon steel alloy components. Bowls, for example, are conventionally made from stainless steel and may weigh in excess of 300 lbs. However, the size and weight of stainless steel centrifuge components are problematic. At the high rotational speeds required for high separation efficiency, most of the bending stress on the bowl derives from the "G" force acting on the weight of the steel bowl wall itself. Making the bowl thicker just increases this stress. Secondly, due to their size and weight, centrifuge components are expensive to manufacture and ship, as well as cause safety concerns due to the high rotational speed of the components. Thirdly, due to the size and weight of centrifuge components, additional costs are incurred for oversized drive and related support components that are sufficient to maintain the structural integrity of the centrifuge during operation.

Another concern with conventional centrifuges is the expense of the components. As discussed, the components are typically made from stainless steel and other costly alloys, which are expensive to manufacture and maintain. In addition, the components must be manufactured with high precision because of the high G forces occurring during operation, which further increases the cost of conventional centrifuge components.

The expense of conventional centrifuge components is compounded by the fact that centrifuge components are expensive to maintain and repair. As discussed previously, components are subject to wear due to corrosion and mechanical abrasion, among other factors. For example, the repetitive high G forces during operation may cause components to warp or distort over time. This wear negatively affects the precision of the components, thereby requiring maintenance or replacement to keep the centrifuge in operational condition. However, it is often difficult and time consuming to remove and/or replace centrifuge components. This often leads to re-welding and re-machining of parts at the jobsite, which can result in increased machine vibrations and significant centrifuge downtime.

Accordingly, there exists a need for improved centrifuges and improved methods for separating oilfield solids and liquids.

SUMMARY OF INVENTION

In some aspects, embodiments disclosed herein relate to a centrifuge, including a bowl having a composite material, a screw conveyor rotatably mounted within the bowl, and a feed pipe mounted within the screw conveyor for feeding a drilling mud through a feed port in a wall of the screw conveyor to an annular space between the bowl and the wall of the screw conveyor.

In some aspects, embodiments disclosed herein relate to a method of replacing a centrifuge component, including removing the centrifuge component and installing a new centrifuge component, where the centrifuge components include a bowl and a screw conveyor rotatably mounted within the bowl, and where the new centrifuge component includes a composite material.

Other aspects and advantages of the invention will be apparent from the following description and the appended claims.

DETAILED DESCRIPTION

Figure 1:
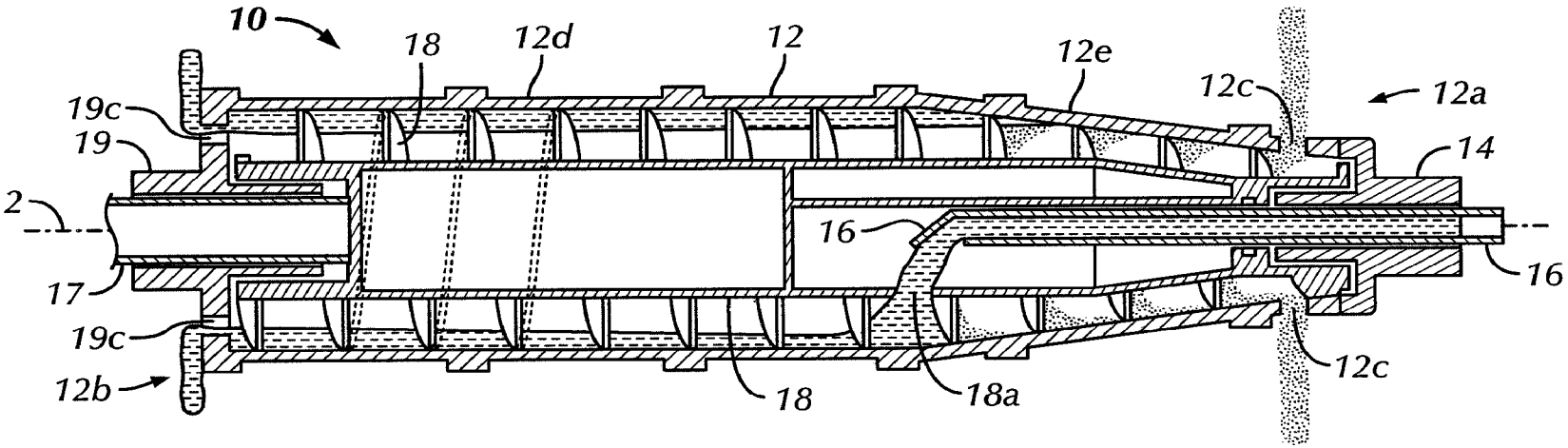
FIG. 1 is a schematic of a centrifuge in accordance with embodiments disclosed herein.

In some aspects, embodiments disclosed herein relate generally to decanting centrifuges for the separation of a suspension with one or more liquid and solid phases of different specific gravities. In other aspects, embodiments disclosed herein relate to decanting centrifuges used for separating and removing solids from a fluid. In still other aspects, embodiments disclosed herein relate to decanting centrifuges for separating and removing solids from drilling fluids.

Embodiments disclosed herein also relate to methods of separating and removing solids from liquids in a fluid using centrifuges having composite materials. In certain embodiments, the centrifuges disclosed herein include components formed from composite materials, and the composite materials may include carbon-fiber reinforced materials, epoxy resins, and carbon-fiber epoxy resins, among others.

In other embodiments, the centrifuges disclosed herein relate to centrifuge components having reduced weight. In some aspects, embodiments disclosed herein relate to centrifuge components having reduced weight while maintaining or improving strength and rigidity of centrifuge components. In certain aspects, embodiments disclosed herein relate to centrifuge components having reduced weight while maintaining or improving rotational speed during operation.

In some embodiments, centrifuges disclosed herein have replaceable components. In some embodiments, the bowl is removable and replaceable, while in other embodiments, centrifuge components other than the bowl are removable and replaceable. In certain embodiments, centrifuge components may be replaceable as an assembly, such as a rotating assembly.

In some embodiments, various components may be incorporated in centrifuge components. For example, embedded components may include, but are not limited to, sensors and/or electrical wires used to transmit data.

As used herein, "torque" refers to a force required to rotate the centrifuge for separating solids in the drilling fluids. The torque is supplied to a driving shaft of the centrifuge by a driver, for example, an electrical motor, a gas turbine, or a combustion engine. Where a variable torque is required due to changes in the throughput or the feed weighting characteristics, a torque adjustment device, for example, a gearbox or adjustable speed drive may be used.

As used herein, "G force" refers to centrifugal force generated by the rotation of the centrifuge and/or the screw conveyor in response to the applied torque. The G force is used in a centrifuge to separate components, such as solids and fluids, based on the relative densities of the components. For example, the heavier solids will accumulate on the outside periphery of a centrifuge chamber, whereas the lighter fluids will accumulate closer to an axis of the centrifuge rotation.

Various compositions of drilling fluids may be efficiently separated using centrifuges according to embodiments disclosed herein. Furthermore, the separation of various solids and liquids can be improved using centrifuges according to embodiments disclosed herein.

Referring to FIG. 1, a centrifuge 10 according to embodiments of the present disclosure is shown. Centrifuge 10 has a bowl 12, supported for rotation about a longitudinal axis 2, wherein a large bowl section 12*d* has an open end 12*b*, and a conical section 12*e* has an open end 12*a*, with the open end 12*a* receiving a drive flange 14, which is connected to a drive shaft (not illustrated) for rotating the bowl 12. The drive flange 14 has a single longitudinal passage, which receives a feed pipe 16 for introducing a drilling fluids feed into the interior of the bowl 12. A screw conveyor 18 extends within the bowl 12 in a coaxial relationship thereto and is supported for rotation within the bowl 12. A hollow flanged shaft 19 is disposed in the end 12*b* of the bowl 12 and receives a drive shaft 17 of an external planetary gear box for rotating the screw conveyor 18 in the same direction as the bowl 12 at a selected speed.

The wall of the screw conveyor 18 has a feed port 18*a* near the outlet end of the feed pipe 16 so that the centrifugal forces generated by the rotating bowl 12 move the drilling fluid radially outward through the feed port 18*a* into the annular space between the screw conveyor 18 and the bowl 12. The annular space can be located anywhere along the large bowl section 12*d* or the conical section 12*e* of bowl 12. The fluid portion of the drilling fluid is displaced toward the end 12*b* of the bowl 12 and recovered through one or more fluid discharge ports 19*c*. The entrained solids in the drilling fluid slurry settle toward the inner surface of the bowl 12 due to the G forces generated, and are scraped and displaced by the screw conveyor 18 toward the end 12*a* of the bowl for discharge through a plurality of solids discharge ports 12*c* formed in the wall of the bowl 12 near end 12*a*. The centrifuge 10 is typically enclosed in a housing or casing (not shown).

Centrifuges disclosed herein include one or more components having at least one composite material. Composite materials, including polymer-based composite materials and carbon fiber-reinforced composite materials, are lightweight and have excellent mechanical properties, such as strength, among others. For example, the ability to mold composite materials may be advantageous for many reasons, including but not limited to, the ability to achieve unique geometries, reduced costs associated with forming and/or reworking centrifuge components, and reduced costs due to the smaller size and/or weight of centrifuge components. As another example, feed pipe 16 may be molded in a shape to impart specific flow to the slurry entering centrifuge 10, thereby improving the separation of liquids and solids.

Further, centrifuges disclosed herein may include steel inserts. For example, in certain embodiments, centrifuges disclosed herein may incorporate steel inserts with the composite materials, or centrifuges disclosed herein may include stainless steel pegs to connect composite materials.

Centrifuges disclosed herein may include other components embedded in the composite matrix of specific centrifuge components. For example, sensors may be embedded in the composite material, such as in the wall of the bowl, inlet, outlets, or the conical section, so that aspects of centrifuge operation may be monitored during operation. In certain aspects, the sensors may include flow rate sensors, temperature sensors, pressure sensors, etc. Electrical wires may be coupled to the sensors and used to transmit data from the centrifuge component to a central data collection system, such as a programmable logic control, computer, or the like. In other embodiments, the sensors may be operative coupled to remote communication devices, thereby allow signals from the sensors to be transmitted wirelessly. In such embodiments, the data from multiple sensors from one or more components may be compiled in a central computing device to allow for the determination of centrifuge operation parameters. Examples of centrifuge operation parameters may include stress, strain, temperature, acceleration, flow rate, etc., and may thereby allow for the continuous or substantially continuous determination of centrifuge performance.

Still further, centrifuges disclosed herein may include tungsten carbide hardfacing or other hardfacing materials. In certain embodiments, a hardfacing material may be applied at locations where solids contact the centrifuge or where flow increases or decreases. For example, in some embodiments, a hardfacing material may be applied at inlet or outlet ports, where solids are inserted or removed. Examples of hardfacing may include tungsten carbide or tungsten carbide cobalt in matrix alloys of, for example, bronze, nickel, boron, carbon, silicon, iron, etc.

Embodiments of the present disclosure may further provide for a modular design for a centrifuge, thereby allowing one or more components to be formed from a high strength composite material. Various high strength composite materials are described in detail below, however, those of ordinary skill in the art will appreciate that any high strength fiber reinforced composite may be used to foil one or more components of a centrifuge. In certain aspects, the bowl of the centrifuge may be formed as a first composite component, while a discharge end is formed as a second component and coupled to the bowl. In such an embodiment, the discharge end may be formed from a composite material, or alternatively, may be formed from metal and/or metal alloys, such as stainless steel. Because the discharge end of the centrifuge may include complex geometry, apertures, and the like, it may be more efficient to manufacture the discharge end by casting the component from stainless steel and coupling the discharge end to the composite bowl. Depending on the material the discharge end is manufactured from, the method of coupling the discharge end to the bowl may vary. For example, in an embodiment where the discharge end is formed from a composite, the composite may effectively be welded to the bowl using one or more chemical adhesives. Other methods for coupling a composite discharge end to the bowl may include threaded connections, thermal bonding, and the like. In an embodiment where a metal discharge end is coupled to a composite bowl, the bowl and discharge end may include threadingly engageable connections and/or other structural components to provide a mechanical connection therebetween.

Various methods may be employed for production of high strength composite materials, including open molding techniques, such as filament winding, chopped lamination, and hand lay-up, as well as closed molding techniques, such as compression molding, pultrusion, reinforced injection molding, resin transfer molding, vacuum bag molding, vacuum infusion processing, centrifugal casting, and continuous lamination. In a specific embodiment, filament winding may be used. Filament winding provides an automated molding process that uses a rotating mandrel as a mold. The male mold provides a finished inner surface and a laminate surface on the outside diameter of the product. Filament winder also provides a high degree of fiber loading, which thereby provides high tensile strengths desirable in centrifuge bowls. Compression molding may provide for the molding of components having a complex geometry, such as discharge ends of centrifuges. Compression molding consists of using heated metal molds mounded in large presses. Those of ordinary skill in the art will appreciate that any type of suitable molding process for manufacturing composite centrifuges components disclosed herein may be used. Below is a detailed description of using filament winding in forming a centrifuge bowl of the present invention.

In typical methods employing prepregs, a formed product of a composite material may be obtained by stacking prepregs and applying heat. Carbon and/or glass fibers may be circular or noncircular and may have various functional groups, including but not limited to, oxygen-containing, nitrogen-containing, hydroxylic-containing, and carboxylic-containing functional groups, and/or combinations thereof. Exemplary matrix resins used for prepregs include thermoplastic resins and thermosetting resins, as well as epoxy resins, maleimide resins, cyanate resins and polyimide resins. Prepregs may be subjected to surface treatments, including but not limited to, oxidation.

Embodiments of the present disclosure may use various methods of constructing centrifuge components. Embodiments may use one or more layers of composite material and/or various composite materials, for example, oriented films, fibrous layers, and/or combinations thereof. In some embodiments, a resin matrix may be used with fibrous layers, and a film (oriented or not) may include the resin matrix.

Examples of films include uniaxially or biaxially oriented films that may be single layer, bilayer, or multilayer, and may include, for example, homopolymers and copolymers of thermoplastic polyolefins, thermoplastic elastomers, crosslinked thermoplastics, crosslinked elastomers, polyesters, polyamides, fluorocarbons, urethanes, epoxies, polyvinylidene chloride, polyvinyl chloride, and blends thereof. Films include, but are not limited to, high density polyethylene, polypropylene, and polyethylenelelastomeric blends. Film thickness may range from about 0.2 to 40 milli-inches ("mils"), from about 0.5 to 20 mils, or from about 1 to 15 mils.

For purposes of the present disclosure, a fibrous layer may include at least one network of fibers, either alone or with a matrix. Fiber denotes an elongated body, the length dimension of which is much greater than the transverse dimensions of width and thickness. Accordingly, the term fiber includes but is not limited to, monofilament, multifilament, ribbon, strip, staple, and other forms of chopped, cut, or discontinuous fiber and the like having regular or irregular cross-sections. The term fiber may also include a plurality of any one or combination of the above.

The diameter of cross-sections of filaments used in embodiments disclosed herein may vary, for example, cross-sections may be circular, flat, or oblong in cross-section. The cross-sections may also be irregular or regular multi-lobal, having one or more regular or irregular lobes projecting from the linear or longitudinal axis of the fibers.

A network may include a plurality of fibers arranged into a predetermined configuration or a plurality of fibers grouped together to form a twisted or untwisted yarn, which yarns are then arranged into a predetermined configuration. For example, the fibers or yarn may be formed as a felt or other nonwoven, knitted or woven (plain, basket, satin, and crow feet weaves, etc.) into a network, or formed into a network by any conventional techniques. In some embodiments, the fibers are unidirectionally aligned so that they are substantially parallel to each other along a common fiber direction. Continuous length fibers may also be used in embodiments disclosed herein.

Continuous bands disclosed herein may be fabricated using a number of procedures. In some embodiments, the bands, especially those without resin matrix, may be formed by winding fabric around a mandrel and securing the shape by suitable securing means, e.g., heat and/or pressure bonding, heat shrinking, adhesives, staples, sewing, and other securing means known to those of skill in the art. Sewing may be either spot sewing, line sewing, or sewing with intersecting sets of parallel lines. Stitches are typically utilized in sewing, but no specific stitching type or method constitutes a preferred securing means for use in this disclosure. Fiber used to form stitches may also vary widely. Fiber for use in the stitches may have a tenacity equal to or greater than about 2 grams/denier (g/d) and a Young's modulus equal to or greater than about 20 g/d. Another way to form wraps of fabric selectively rigid within a band is by way of stitch patterns, e.g., parallel rows of stitches can be used across the face portions of the band to make them rigid while leaving the joints/edges unsewn to create another "collapsible" rigid band.

In some embodiments, improved material properties may be obtained by combining different types of strips, such as pultruded fibrous composite strips. Some examples of fibrous composite strips have been described above. Other fibrous composite strips may include different fibers, such as carbon fibers, glass fibers and/or natural fibers, and composite strips formed as hollow tubes, among others. Each of these types of strips may be simpler, and thus cheaper, to manufacture than to form an entire component and the strips may be joined by suitable methods, such as by injection of resin or by vacuum infusion of resin.

The type of fibers used in embodiments disclosed herein may vary widely and can be inorganic or organic fibers. Exemplary fibers may include those having a tenacity equal to or greater than about 10 g/d and a tensile modulus equal to or greater than about 200 g/d. Further examples of fibers are those having a tenacity equal to or greater than about 20 g/d and a tensile modulus equal to or greater than about 500 g/d. More specifically, the tenacity of the fibers may be equal to or greater than about 25 g/d and the tensile modulus equal to or greater than about 1000 g/d. In the practice of embodiments of the present disclosure, the fibers may have a tenacity equal to or greater than about 30 g/d and a tensile modulus equal to or greater than about 1200 g/d, for example.

Useful inorganic fibers may include S-glass fibers, E-glass fibers, carbon fibers, boron fibers, alumina fibers, zirconia-silica fibers, alumina-silica fibers, and the like.

Exemplary inorganic filaments may include glass fibers such as fibers formed from quartz, magnesia alumuninosilicate, non-alkaline aluminoborosilicate, soda borosilicate, soda silicate, soda lime-aluminosilicate, lead silicate, non-alkaline lead boroalumina, non-alkaline barium boroalumina, non-alkaline zinc boroalumina, non-alkaline iron aluminosilicate, cadmium borate, alumina fibers which include "saffil" fiber in eta, delta, and theta phase form, asbestos, boron, silicone carbide, graphite and carbon such as those derived from the carbonization of saran, polyaramide (including Nomex® and Kevlar®), nylon, polybenzimidazole, polyoxadiazole, polyphenylene, PPR, petroleum and coal pitches (isotropic), mesophase pitch, cellulose and polyacrylonitrile, ceramic fibers, metal fibers as for example steel, aluminum metal alloys, and the like.

Exemplary organic filaments may include those composed of polyesters, polyolefins, polyetheramides, fluoropolymers, polyethers, celluloses, phenolics, polyesteramides, polyurethanes, epoxies, aminoplastics, silicones, polysulfones, polyetherketones, polyetheretherketones, polyesterimides, polyphenylene sulfides, polyether acryl ketones, poly(amideimides), and polyimides. Illustrative of other useful organic filaments are those composed of aramids (aromatic polyamides), such as poly(m-xylylene adipamide), poly(p-xylylene sebacamide), poly(2,2,2-trimethylhexamethylene terephthalamide), poly(piperazine sebacamide), poly(metaphenylene isophthalamide) and poly(p-phenylene terephthalamide); aliphatic and cycloaliphatic polyamides, such as the copolyamide of 30% hexamethylene diammonium isophthalate and 70% hexamethylene diammonium adipate, the copolyamide of up to 30% bis-(-amidocyclohexyl)methylene, terephthalic acid and caprolactam, polyhexamethylene adipamide (nylon 66), poly(butyrolactam) (nylon 4), poly(9-aminonoanoic acid) (nylon 9), poly(enantholactam) (nylon 7), poly(capryllactam) (nylon 8), polycaprolactam (nylon 6), poly(p-phenylene terephthalamide), polyhexamethylene sebacamide (nylon 6,10), polyaminoundecanamide (nylon 11), polydodecanolactam (nylon 12), polyhexamethylene isophthalamide, polyhexamethylene terephthalamide, polycaproamide, poly(nonamethylene azelamide (nylon 9,9), poly(decamethylene azelamide) (nylon 10,9), poly(decamethylene sebacamide) (nylon 10,10), poly[bis-(4-aminocyclohexyl)methane 1,10-decanedicarboxamide] (Qiana) (trans), or combinations thereof; and aliphatic, cycloaliphatic and aromatic polyesters such as poly(1,4-cyclohexylidene dimethyl eneterephthalate)cis and trans, poly(ethylene-1,5-naphthalate), poly(ethylene-2,6-naphthalate), poly(1,4-cyclohexane dimethylene terephthalate)(trans), poly(decamethylene terephthalate), poly(ethylene terephthalate), poly(ethylene isophthalate), poly(ethylene oxybenzoate), poly(para-hydroxy benzoate), poly(dimethylpropiolactone), poly(decamethylene adipate), poly(ethylene succinate), poly(ethylene azelate), poly(decamethylene sabacate), poly(alpha,alpha-dimethylpropiolactone), and the like.

Alternative organic filaments may include those of liquid crystalline polymers such as lyotropic liquid crystalline polymers which include polypeptides such as poly-alpha-benzyl L-glutamate and the like; aromatic polyamides such as poly(1,4-benzamide), poly(chloro-1-4-phenylene terephthalamide), poly(1,4-phenylene fumaramide), poly (chloro-1,4-phenylene fumaramide), poly(4,4'-benzanilide trans, trans-muconamide), poly(1,4-phenylene mesaconamide), poly(1,4-phenylene)(trans-1,4-cyclohexylene amide), poly(chloro-1,4-phenylene)(trans-1,4-cyclohexylene amide), poly(1,4-phenylene 1,4-dimethyl-trans-1,4-cyclohexylene amide), poly(1,4-phenylene 2,5-pyridine amide), poly(chloro-1,4-phenylene 2,5-pyridine amide), poly(3,3'-dimethyl-4,4'-biphenylene 2,5 pyridine amide), poly(1,4-phenylene 4,4'-stilbene amide), poly(chloro-1,4-phenylene 4,4'-stilbene amide), poly(1,4-phenylene 4,4'-azobenzene amide), poly(4,4'-azobenzene 4,4'-azobenzene amide), poly(1,4-phenylene 4,4'-azoxybenzene amide), poly (4,4'-azobenzene 4,4'-azoxybenzene amide), poly(1,4-cyclohexylene 4,4'-azobenzene amide), poly(4,4'-azobenzene terephthal amide), poly(3,8-phenanthridinone terephthal amide), poly(4,4'-biphenylene terephthal amide), poly(4,4'-biphenylene 4,4'-bibenzo amide), poly(1,4-phenylene 4,4'-bibenzo amide), poly(1,4-phenylene 4,4'-terephenylene amide), poly(1,4-phenylene 2,6-naphthal amide), poly(1,5-naphthalene terephthal amide), poly(3,3'-dimethyl-4,4-biphenylene terephthal amide), poly(3,3'-dimethoxy-4,4'-biphenylene terephthal amide), poly(3,3'-dimethoxy-4,4-biphenylene 4,4'-bibenzo amide) and the like; polyoxamides such as those derived from 2,2'-dimethyl-4,4'-diamino biphenyl and chloro-1,4-phenylene diamine, polyhydrazides such as poly chloroterephthalic hydrazide, 2,5-pyridine dicarboxylic acid hydrazide)poly(terephthalic hydrazide), poly(terephthalic-chloroterephthalic hydrazide) and the like; poly(amide-hydrazides) such as poly(terephthaloyl 1,4 amino-benzhydrazide) and those prepared from 4-amino-benzhydrazide, oxalic dihydrazide, terephthalic dihydrazide and para-aromatic diacid chlorides; polyesters such as those of the compositions include poly(oxy-trans-1,4-cyclohexyleneoxycarbonyl-trans-1,4-cyclohexylenecarbon-yl-beta-oxy-1,4-phenyl-eneoxyteraphthaloyl) and poly(oxy-cis-1,4-cyclohexyleneoxycarbonyl-trans-1,4-cyclohexylenecarbonyl-beta-oxy-1,4-henyleneoxyterephthaloyl) in methylene chloride-o-cresol poly(oxy-trans-1,4-cyclohexylene oxycarbonyl-trans-1,4-cyclohexylenecarbonyl-b-oxy-(2-methyl-1,4-phenylene-) oxy-terephthaloyl) in 1,1,2,2-tetrachloroethane-o-chlorophenol-phenol (60:25:15 vol/vol/vol), poly[oxy-trans-1,4-cyclohexyleneoxycarbonyl-trans-1,4-cyclohexylenecarbon-yl-b-oxy(2-methyl-1,3-phenylene)oxy-terephthaloyl] in o-chlorophenol and the like; polyazomethines such as those prepared from 4,4'-diaminobenzanilide and terephthalaldehyde, methyl-1,4-phenylenediamine and terephthalaldehyde and the like; polyisocyanides such as poly(-phenyl ethyl isocyanide), poly(n-octyl isocyanide) and the like; polyisocyanates such as poly(n-alkyl isocyanates) as for example poly(n-butyl isocyanate), poly(n-hexyl isocyanate) and the like; lyotropic crystalline polymers with heterocyclic units such as poly(1,4-phenylene-2,6-benzobisthiazole) (PBT), poly(1,4-phenylene-2,6-benzobisoxazole) (PEO), poly(1,4-phenylene-1,3,4-oxadiazole), poly(1,4-phenylene-2,6-benzobisimidazole), poly[2,5(6)-benzimidazole] (AB-PBI), poly[2,6-(1,4-phenylene-4-phenylquinoline], poly[1,1'-(4,4'-biphenylene)-6,6'-bis(4-phenylquinoline)] and the like; polyorganophosphazines such as polyphosphazine, polybis-phenoxyphosphazine, poly[bis(2,2,2' trifluoroethylene) phosphazine] and the like; metal polymers such as those derived by condensation of trans-bis(tri-n-butylphosphine) platinum dichloride with a bisacetylene or trans-bis(tri-n-butylphosphine)bis(1,4-butadienyl)platinum and similar combinations in the presence of cuprous iodine and an amide; cellulose and cellulose derivatives such as esters of cellulose as for example triacetate cellulose, acetate cellulose, acetate-butyrate cellulose, nitrate cellulose, and sulfate cellulose, ethers of cellulose as for example, ethyl ether cellulose, hydroxymethyl ether cellulose, hydroxypropyl ether cellulose, carboxymethyl ether cellulose, ethyl hydroxyethyl ether cellulose, cyanoethylethyl ether cellulose, ether-esters of cellulose as for example acetoxyethyl ether cellulose and benzoyloxypropyl ether cellulose, and urethane cellulose as for example phenyl urethane cellulose; thermotropic liquid crystalline polymers such as celluloses and their derivatives as for example hydroxypropyl cellulose, ethyl cellulose propionoxypropyl cellulose; thermotropic copolyesters as for example copolymers of 6-hydroxy-2-naphthoic acid and p-hydroxy benzoic acid, copolymers of 6-hydroxy-2-naphthoic acid, terephthalic acid and p-amino phenol, copolymers of 6-hydroxy-2-naphthoic acid, terephthalic acid and hydroquinone, copolymers of 6-hydroxy-2-naphthoic acid, p-hydroxy benzoic acid, hydroquinone and terephthalic acid, copolymers of 2,6-naphthalene dicarboxylic acid, terephthalic acid, isophthalic acid and hydroquinone, copolymers of 2,6-naphthalene dicarboxylic acid and terephthalic acid, copolymers of p-hydroxybenzoic acid, terephthalic acid and 4,4'-dihydroxydiphenyl, copolymers of p-hydroxybenzoic acid, terephthalic acid, isophthalic acid and 4,4'-dihydroxydiphenyl, p-hydroxybenzoic acid, isophthalic acid, hydroquinone and 4,4'-dihydroxybenzophenone, copolymers of phenylterephthalic acid and hydroquinone, copolymers of chlorohydroquinone, terephthalic acid and p-acetoxy cinnamic acid, copolymers of chlorohydroquinone, terephthalic acid and ethylene dioxy-r,r'-dibenzoic acid, copolymers of hydroquinone, methylhydroquinone, p-hydroxybenzoic acid and isophthalic acid, copolymers of (1-phenylethyl)hydroquinone, terephthalic acid and hydroquinone, and copolymers of poly(ethylene terephthalate) and p-hydroxybenzoic acid; and thermotropic polyamides and thermotropic copoly (amide-esters).

Other organic filaments may include those composed of extended chain polymers formed by polymerization of unsaturated monomers of Equation 1:

$$C{=}R_1R_2{-}C{=}CH_2 \quad (1)$$

In Equation 1, $R_1R_2$ may be the same or different and are hydrogen, hydroxy, halogen, alkylcarbonyl, carboxy, alkoxycarbonyl, heterocycle or alkyl or aryl either unsubstituted or substituted with one or more substituents selected from the group consisting of alkoxy, cyano, hydroxy, alkyl and aryl. Illustrative of such polymers of alpha,beta-unsaturated monomers are polymers including polystyrene, polyethylene, polypropylene, poly(1-octadecene), polyisobutylene, poly(1-pentene), poly(2-methylstyrene), poly(4-methylstyrene), poly(1-hexene), poly(4-methoxystyrene), poly(5-methyl-1-hexene), poly(4-methylpentene), poly(1-butene), polyvinyl chloride, polybutylene, polyacrylonitrile, poly(methyl pentene-1), poly(vinyl alcohol), poly(vinyl acetate), poly(vinyl butyral), poly(vinyl chloride), poly(vinylidene chloride), vinyl chloride-vinyl acetate chloride copolymer, poly(vinylidene fluoride), poly(methyl acrylate), poly(methyl methacrylate), poly(methacrylonitrile), poly (acrylamide), poly(vinyl fluoride), poly(vinyl formal), poly (3-methyl-1-butene), poly(4-methyl-1-butene), poly(4-methyl-1-pentene), poly(1-hexane), poly(5-methyl-1-hexene), poly(1-octadecene), poly(vinyl cyclopentane), poly (vinylcyclohexane), poly(a-vinylnaphthalene), poly(vinyl methyl ether), poly(vinylethylether), poly(vinyl propylether), poly(vinyl carbazole), poly(vinyl pyrrolidone), poly (2-chlorostyrene), poly(4-chlorostyrene), poly(vinyl formate), poly(vinyl butyl ether), poly(vinyl octyl ether), poly (vinyl methyl ketone), poly(methylisopropenyl ketone), poly(4-phenylstyrene) and the like.

Examples of high strength fibers may include extended chain polyolefin fibers, particularly extended chain polyethylene (ECPE) fibers, aramid fibers, polyvinyl alcohol fibers, polyacrylonitrile fibers, liquid crystal copolyester fibers, polyamide fibers, glass fibers, carbon fibers and/or mixtures thereof, and for example, polyolefin and aramid fibers. If a mixture of fibers is used, the fibers may be a mixture of at least two of polyethylene fibers, aramid fibers, polyamide fibers, carbon fibers, and glass fibers.

If a matrix material is used in forming the centrifuge components, it may comprise one or more thermosetting resins, or one or more thermoplastic resins, or a blend of such resins. The choice of a matrix material will depend on how the bands are to be formed and used. The desired rigidity of the band and/or ultimate container will greatly influence choice of matrix material. As used herein "thermoplastic resins" are resins which can be heated and softened, cooled and hardened a number of times without undergoing a basic alteration, and "thermosetting resins" are resins which cannot be resoftened and reworked after molding, extruding or casting and which attain new, irreversible properties when once set at a temperature which is critical to each resin.

Thermosetting resins may include, bismaleimides, alkyds, acrylics, amino resins, urethanes, unsaturated polyesters, silicones, epoxies, vinylesters and mixtures thereof.

Thermoplastic resins may include polylactones, polyurethanes, polycarbonates, polysulfones, polyether ether ketones, polyamides, polyesters, poly(arylene oxides), poly (arylene sulfides), vinyl polymers, polyacrylics, polyacrylates, polyolefins, ionomers, polyepichlorohydrins, polyetherimides, liquid crystal resins, and elastomers and copolymers and mixtures thereof. Exemplary thermoplastic resins may include high density, low density, and linear low density polyethylenes. A broad range of elastomers may be used, including natural rubber, styrene-butadiene copolymers, polyisoprene, polychloroprene-butadiene-acrylonitrile copolymers, ER rubbers, EPDM rubbers, and polybutylenes.

In some embodiments of the invention, the matrix may include a polymeric matrix such as a low density polyethylene, a polyurethane, a flexible epoxy, a filled elastomer vulcanizate, a thermoplastic elastomer, and/or a modified nylon-6.

If a matrix resin is used, it may be applied to the fibers in a variety of ways, such as, for example, encapsulation, impregnation, lamination, extrusion coating, solution coating, and solvent coating.

In certain embodiments, one or more uncured thermosetting resin-impregnated networks of high strength filaments may be formed into a flexible sheet for winding around the mandrel into a band or bands in accordance with embodiments of the present disclosure followed by curing (or spot curing) of the resin.

Film may also be used as one or more layers of the band(s). The film, or films, may be added as the matrix material, with the matrix material, or after the matrix material. When the film is added as the matrix material, it may be simultaneously wound with the fiber or fabric (network) onto a mandrel and subsequently consolidated; such that the mandrel may become part of the structure. The film thickness minimally is about 0.1 mil and may be as large as desired so long as the length is still sufficiently flexible to permit band formation. Exemplary film thickness ranges from 0.1 to 50 mil or from 0.35 to 10 mil. Films can also be used on the surfaces of the bands for a variety of reasons, e.g., to vary frictional properties, to increase chemical resistance, and/or to prevent diffusion of material into the matrix. The film may or may not adhere to the band depending on the choice of film, resin and filament. Heat and/or pressure may cause the desired adherence, or it may be necessary to use an adhesive which is heat or pressure sensitive between the film and the band to cause the desired adherence. Examples of acceptable adhesives include polystyrene-polyisoprene-polystyrene block copolymer, thermoplastic elastomers, thermoplastic and thermosetting polyurethanes, thermoplastic and thermosetting polysulfides, and typical hot melt adhesives.

Films which may be used as matrix materials in embodiments disclosed herein may include thermoplastic polyolefinic films, thermoplastic elastomeric films, crosslinked thermoplastic films, crosslinked elastomeric films, polyester films, polyamide films, fluorocarbon films, urethane films, polyvinylidene chloride films, polyvinyl chloride films and multilayer films. Homopolymers or copolymers of these films can be used, and the films may be unoriented, uniaxially oriented or biaxially oriented.

Useful thermoplastic polyolefinic films include those of low density polyethylene, high density polyethylene, linear low density polyethylene, polybutylene, and copolymers of ethylene and propylene which are crystalline. Polyester films which may be used include those of polyethylene terephthalate and polybutylene terephthalate.

The temperatures and/or pressures to which the bands of embodiments disclosed herein are exposed to cure the thermosetting resin or to cause adherence of the networks to each other and optionally, to at least one sheet of film, vary depending upon the particular system used.

In certain embodiments, bands may be formed with fibrous layers using elastomeric resin systems, thermosetting resin systems, or resin systems where a thermoplastic resin is combined with an elastomeric or thermosetting resin may be treated with pressure alone to consolidate the band. In other embodiments, bands formed with continuous lengths/plies utilizing thermoplastic resin systems may be treated with heat, alone or combined with pressure, to consolidate the band.

Figure 2A:
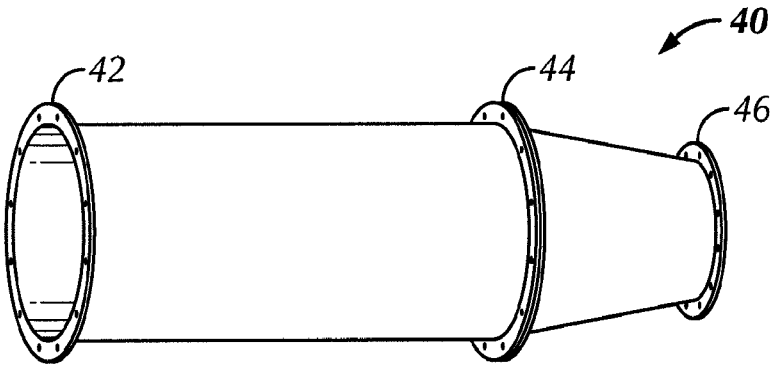
FIG. 2A is a schematic of an exemplary bowl design in accordance with embodiments disclosed herein.

FIG. 2A is a schematic of an exemplary bowl formed in accordance with embodiments disclosed herein. In some embodiments the bowl 40 may be formed from carbon fiber epoxy resin using methods in accordance with embodiments disclosed herein. More specifically, bowl 40 may be formed using a filament wound tube, as described herein. For example, bowl 40 may be formed by winding fabric around a mandrel and securing the shape by pressure bonding. The fabric may be a carbon fiber with epoxy resin. Flanges 42, 44, and 46 may be manufactured separately and machined on after molding, or in certain embodiments, may be integrally formed therewith.

In some embodiments, the bowl 40 as illustrated in FIG. 2A may provide several advantages over conventional centrifuge bowls. Bowl 40 may have a lower weight than conventional bowls, for example, 30% to 60% or greater reduction in weight. The reduced weight may thus enable the centrifuge to operate at higher RPM without increasing the drive power required. In certain embodiments, bowl 40 may be formed into a more symmetrical shape than conventional bowls, and may maintain its shape for a longer period of time than conventional bowls due to the use of composite materials as described herein. In further embodiments, the reduced weight and/or improvements in shape of bowl 40 may reduce vibrations while simultaneously allowing operation at higher RPM, thereby increasing efficiency and reliability. For example, the shape and reduced weight of the centrifuge bowl may allow the bowl to rotate at a rotational speed yielding 3,000 to 4,000 g-forces or "G's." In still further embodiments, the lighter weight of bowl 40 and reduced vibrations may result in safer operation of centrifuges described herein because these factors, among others, may reduce the likelihood of structural failure of the centrifuge, for example the possibility of bowl 40 breaking out of the protective housing or casing of the centrifuge. Further, methods of forming the bowl 40 may be more efficient than conventional methods, providing cost savings. Still further, bowl 40 may be removed and replaced at any time without replacing other parts of the centrifuge. Thus, the lighter weight of bowl 40 may subsequently provide cost savings for shipping, handling, and structural requirements, among others.

Figure 2B:
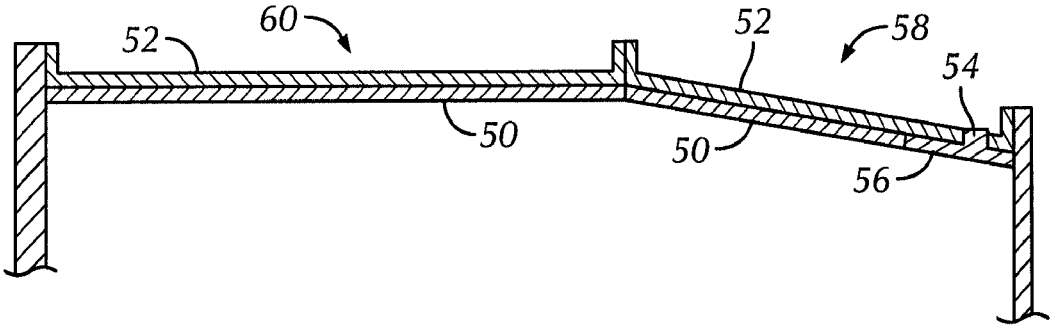
FIG. 2B is a schematic of an exemplary bowl design in accordance with embodiments disclosed herein.

Referring to FIG. 2B, a cross-sectional view of one side of a centrifuge bowl in accordance with some embodiments disclosed herein, is shown. In FIG. 2B, the composite surface 52 of the bowl may be manufactured as described herein. In some embodiments, a sleeve 50 may be bonded separate from the composite surface 52. Sleeve 50 may include, for example, a wear resistant surface, such as a urethane, and may be applied during or after the formation of the bowl. Gaps for the discharge ports 54 may be left in the sleeve 50 and the composite surface 52. Sleeve 50 may be assembled with composite surface 52, matching the gaps in each while watching for thermal affects that may cause expansion and contraction. Assembled sleeve 50 and composite surface 52 thereby create a conical sleeve 58.

Following assembly of sleeve 50 and composite surface 52, a ceramic discharge port 54 may be disposed into the gap in the conical sleeve 58. Further, a ceramic liner 56 may be disposed at the end of the conical portion 58 of the conical sleeve 58. In some embodiments, the combination of various composites and surface treatments disclosed herein may be beneficial, for example, in FIG. 2B, the use of a sleeve 50 in conjunction with the ceramic liner 56 may be beneficial in providing greater wear protection at the junction between the conical portion 58 of the bowl and the cylindrical portion 60 of the bowl. As a centrifuge experiences the highest conveying resistance at the junction between the cylindrical portion 60 and the conical portion 58 and at the small end of the conical section where no liquid pool exists, the ceramic liner 56 may prevent wear and the premature failure of the centrifuge.

In other embodiments, sleeve 50 may be integrated in the manufacture of composite surface 52. For example, the sleeve material may be an external surface of the mandrel used as the filament winder. In an alternative embodiment, the sleeve material may be applied inside of the finished composite part.

Figure 3:
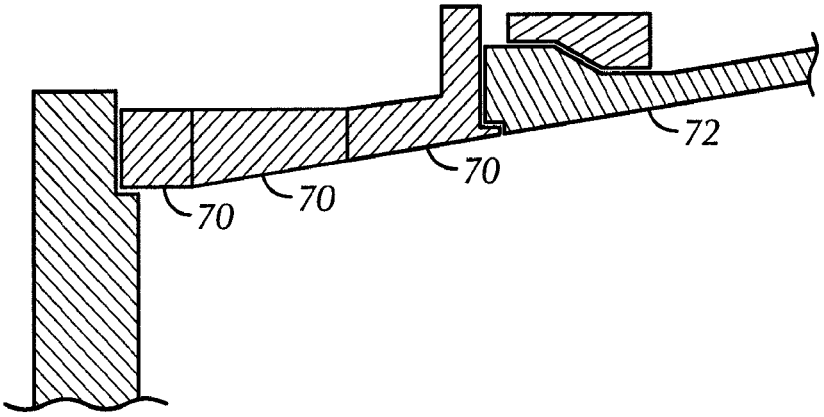
FIG. 3 is a schematic of an exemplary bowl design in accordance with embodiments disclosed herein.

Referring to FIG. 3, a cross-sectional view of one side of a centrifuge bowl in accordance with some embodiments disclosed herein, is shown. In FIG. 3, the composite surface 72 of the bowl may be manufactured as described herein. In some embodiments, a discharge end 70 may be a modular component, separate from the composite surface 72. The discharge end 70 may include variations in design, such as holes to discharge liquids and/or solids. It may also vary in size, for example it may be from four to six inches long in some embodiments, or five inches in others. The discharge end 70 may be made, for example, using methods that are advantageous for forming design variations in the components, such as methods of stainless casting. The discharge end 70 may then be coupled to the composite surface 72 of the bowl. In some embodiments, the discharge end 70 as illustrated in FIG. 3 may provide several advantages over conventional centrifuges resulting from, for example, efficiencies and accuracy of manufacturing and strength of the materials, e.g., metal.

Advantageously, centrifuges according to embodiments disclosed herein may provide a centrifuge or centrifuge components having reduced weight. For example, embodiments disclosed herein may provide, a centrifuge bowl having a reduced weight, or a rotating assembly having a reduced weight. Advantageously, the reduction in weight between a rotating assembly disclosed herein and a conventional rotating assembly may be 30% to 60%, or higher.

Advantageously, one or more centrifuge components according to embodiments disclosed herein may be manufactured using faster, cheaper, and/or more efficient methods than those typically used. Further, centrifuges may be manufactured incorporating improved methods disclosed herein, thus resulting in cost savings. In some embodiments, the cost savings may be 10% to 30% or higher over components or centrifuges made using conventional manufacturing processes.

Advantageously, centrifuges according to embodiments disclosed herein may be able to operate at similar or higher RPMs as conventional centrifuges, while requiring similar or reduced power to provide higher G forces, thereby producing higher efficiency and increasing cost savings. Further, the reduced weight of centrifuge components and/or centrifuges disclosed herein allows for reduced vibrations during operation, thereby reducing wear and improving efficiency and reliability.

Advantageously, centrifuge components according to embodiments disclosed herein may be molded to achieve specific geometries. In some embodiments, the ability to mold centrifuge components may reduce costs associated with their manufacture or rework. In some embodiments, the smaller and/or lighter weight of molded centrifuge components may provide cost savings. In further embodiments, the ability to mold centrifuge components to unique geometries may allow for improved centrifuge operation or efficiency. Also advantageously, methods of manufacturing centrifuge components out of composite materials through filament winding may result in components with higher rigidity and strength and lower tension.

Advantageously, centrifuges according to embodiments disclosed herein may be capable of measuring centrifuge data. In some embodiments, embedded sensors and wires may communicate data regarding centrifuge parameters. In some embodiments, the data may provide improved reliability and performance over centrifuges having metal components, wherein sensors may not be embedded.

Further advantages of centrifuges according to embodiments disclosed herein include the ability to remove and replace centrifuge components. For example, components that experience higher wear rates than others may be replaced to extend the life of the centrifuge or provide other advantages, such as greater efficiency and/or reliability. In one specific example, bowls of centrifuges may be formed according to embodiments of the invention and may be removed and replaced upon experiencing wear. As another example, bowls and screw conveyors may be replaced together as a rotating assembly. Improved ease of removal and replacement provides several advantages, including but not limited to, reduced costs and improved efficiency.

Yet other advantages of centrifuges according to embodiments disclosed herein include improvements in safety. For example, centrifuge components that include composite materials have advantageous properties, including increased strength, reduced weight, and safer failure modes. Thus, centrifuges according to embodiments disclosed herein may operate with reduced vibrations, thereby improving reliability and reducing the likelihood of failures. Further, centrifuges according to embodiments disclosed herein may be of lighter weight than conventional centrifuges and may thus improve operating safety due to less likelihood of failure. Still further, upon failure of a centrifuge including composite materials, the failure provides less likelihood of components breaking out of the protective housing or casing than would conventional centrifuge components.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A drilling mud separation centrifuge, comprising:

a bowl comprising:

a cylindrical section with a first open end; and a conical section with a second open end coupled to the cylindrical section by a flange;

a screw conveyor rotatably mounted within the bowl;

a hollow flanged shaft positioned at least partially within the first open end and configured to rotate the screw conveyor;

a drive flange positioned at least partially within the second open end and configured to rotate the bowl in a same direction as the screw conveyor; and a feed pipe extending at least partially through the drive flange and into the screw conveyor and configured to feed a drilling mud into the screw conveyor, wherein rotation of the bowl causes the drilling mud to flow radially-outward through a feed port in the screw conveyor to an annular space between the screw conveyor and the bowl, wherein a separated fluid portion of the drilling mud flows through the annular space toward the first open end and exits through a fluid discharge port that is defined between the hollow flanged shaft and the cylindrical section of the bowl, wherein a separated solids portion of the drilling mud is pushed through the annular space toward the second open end by the screw conveyor and exits through the conical section of the bowl, wherein the cylindrical section and the conical section of the bowl each include an outer layer of composite material and an inner layer of wear-resistant urethane bonded to the outer layer of composite material, and wherein the conical section of the bowl further includes an inner annular ceramic liner having at least one ceramic discharge port disposed therein for the exit of the separated solids portion, the inner annular ceramic liner being juxtaposed to the inner layer of wear-resistant urethane in the conical section of the bowl.

2. The centrifuge of claim 1, wherein the composite material is selected from a group consisting of carbon fiber, epoxy resin, carbon fiber epoxy resin, glass, aramid, and mixtures thereof.

3. The centrifuge of claim 1, further comprising a modular discharge end coupled to the bowl.

4. The centrifuge of claim 3, wherein the modular discharge end comprises at least one of the composite material and a metal material.

5. A method of replacing the cylindrical section of the drilling mud separation centrifuge according to claim 1, the method comprising: removing the cylindrical section from the conical section; and coupling a new cylindrical section formed of a composite material to the conical section.

6. The method of claim 5, wherein in the rotating step the bowl rotates at a rotational speed resulting in 3,000 to 4,000 g-forces.

7. The method of claim 5, wherein the composite material includes a plurality of fibers having a tenacity equal to or greater than 10 g/d.

8. The method of claim 5, wherein the composite material includes a plurality of fibers having a tensile modulus equal to or greater than 200 g/d.

9. The centrifuge of claim 1, wherein the composite material includes a plurality of fibers having a tenacity equal to or greater than 10 g/d.

10. The centrifuge of claim 1, wherein in the composite material includes a plurality of fibers having a tensile modulus equal to or greater than 200 g/d.

11. A method for separating solids from fluids a drilling mud, the method comprising:

providing a centrifuge comprising:

a bowl having a cylindrical section with a first open; end and a conical section with a second open end coupled to the cylindrical section by a flange;

a screw conveyor rotatably mounted within the bowl;

a hollow flanged shaft positioned at least partially within the first open end and configured to rotate the screw conveyor;

a drive flange positioned at least partially within the second open end and configured to rotate the bowl in a same direction as the screw conveyor;

wherein at least one feed pipe extends at least partially through the drive flange and into the screw conveyor;

feeding the drilling mud via the at least one feed pipe to the centrifuge, rotating the bowl to cause the drilling mud to flow radially-outward through a feed port in the screw conveyor to an annular space between the screw conveyor and the bowl, wherein during said rotating a separated fluid portion of the drilling mud flows through the annular space toward the first open end and exits through a fluid discharge port that is defined between the hollow flanged shaft and the cylindrical section of the bowl, wherein during said rotating a separated solids portion of the drilling mud is pushed through the annular space toward the second open end by the screw conveyor and exits through the conical section of the bowl, wherein the cylindrical section and the conical section of the bowl each include an outer layer of composite material and an inner layer of wear-resistant urethane bonded to the outer layer of composite material, and wherein the conical section of the bowl further includes an inner annular ceramic liner having at least one ceramic discharge port disposed therein for the exit of the separated solids portion, the inner annular ceramic liner being juxtaposed to the inner layer of wear-resistant urethane in the conical section of the bowl.

12. The method of claim 11, wherein the composite material is selected from the group consisting of carbon fiber, epoxy resin, carbon fiber epoxy resin and mixtures thereof.

13. The method of claim 11, wherein in the rotating step the bowl rotates at a rotational speed resulting in 3,000 to 4,000 g-forces.

14. The method of claim 11, wherein the composite material includes a plurality of fibers having a tenacity equal to or greater than 10 g/d.

15. The method of claim 11, wherein the composite material includes a plurality of fibers having a tensile modulus equal to or greater than 200 g/d.

* * * * *